US009239182B2

(12) United States Patent
Lee et al.

(10) Patent No.: US 9,239,182 B2
(45) Date of Patent: Jan. 19, 2016

(54) REFRIGERATOR

(75) Inventors: Sangbong Lee, Seoul (KR); Taehee Lee, Seoul (KR); Younghoon Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 608 days.

(21) Appl. No.: 13/584,073

(22) Filed: Aug. 13, 2012

(65) Prior Publication Data

US 2013/0160476 A1 Jun. 27, 2013

(30) Foreign Application Priority Data

Dec. 21, 2011 (KR) ..... 10-2011-0138852

(51) Int. Cl.
*F25D 11/02* (2006.01)
*F25D 21/04* (2006.01)
*F25D 16/00* (2006.01)

(52) U.S. Cl.
CPC ..... *F25D 21/04* (2013.01); *F25D 11/02* (2013.01); *F25D 16/00* (2013.01); *F28F 2245/00* (2013.01)

(58) Field of Classification Search
CPC ..... F25D 21/04; F25D 11/02; F25D 16/00; F28F 2245/00
USPC ..... 62/190, 275, 441
See application file for complete search history.

(56) References Cited

U.S. PATENT DOCUMENTS 2,096,828 A * 10/1937 Thomas ..... F25D 11/025 62/333
4,513,581 A * 4/1985 Mizobuchi ..... F25B 5/04 62/117
2003/0209025 A1* 11/2003 Lee ..... F25D 21/04 62/272
2007/0028626 A1* 2/2007 Chen ..... F25B 25/00 62/6
2007/0101730 A1* 5/2007 Chen ..... F25D 21/04 62/6
2011/0259041 A1* 10/2011 Kuehl ..... F25B 39/04 62/507

FOREIGN PATENT DOCUMENTS

CN 1060575 4/1992
CN 1181804 5/1998
CN 2465123 12/2001
CN 1880896 12/2006
JP 2006-138552 6/2006
JP 2006138552 A * 6/2006 ..... F25D 21/04

* cited by examiner

*Primary Examiner* — Emmanuel Duke
(74) *Attorney, Agent, or Firm* — Ked & Associates, LLP

(57) ABSTRACT

A refrigerator comprising a refrigerator body having a freezing compartment and a refrigeration compartment; a cooling circuit including a compressor, a first condenser, and a first evaporator to cool the freezing compartment and the refrigeration compartment using a first refrigerant; a thermosiphon that includes a second condenser provided at the refrigeration compartment and a second evaporator provided at the freezing compartment for a second refrigerant to flow; a valve provided to control a flow of the second refrigerant in the thermosiphon; a first heat transfer plate provided between the second condenser and the freezing compartment; a second heat exchange plate provided between the second evaporator and the refrigeration compartment; and a dew collection device provided at an inner side wall of the refrigerator compartment and positioned to correspond to a position of the second heat exchange plate to collect dew formed on the inner side wall of the refrigerator compartment.

20 Claims, 9 Drawing Sheets

REFRIGERATOR

CROSS-REFERENCE TO RELATED APPLICATION(S)

This application claims priority under 35 U.S.C. §119 from Korean Application No. 10-2011-0138852 filed on Dec. 21, 2011, the subject matter of which is incorporated herein by reference.

BACKGROUND

1. Field

A refrigerator is disclosed herein.

2. Background

Refrigerators are well known. However, they suffer from various disadvantages.

BRIEF DESCRIPTION OF THE DRAWINGS

The embodiments will be described in detail with reference to the following drawings in which like reference numerals refer to like elements, wherein.

DETAILED DESCRIPTION

A refrigerator according to embodiments of the disclosure will be described in detail in reference to the accompanying drawings as follows. Reference is made to specific embodiments, examples of which may be illustrated in the accompanying drawings. Wherever possible, same reference numbers may be used throughout the drawings to refer to the same or like parts.

It is to be understood that the phraseology and terminology used herein including technological or scientific terminology are same as the phraseology and terminology understood by those skilled in the art in the art the disclosure pertains to. It is to be understood that the terminology defined in a dictionary used herein is meant to encompass the meaning thereof disclosed in related arts. Unless for the purpose of description and should not be regarded as limiting, the terminology is not meant to be ideal or exaggerated.

Figure 1:
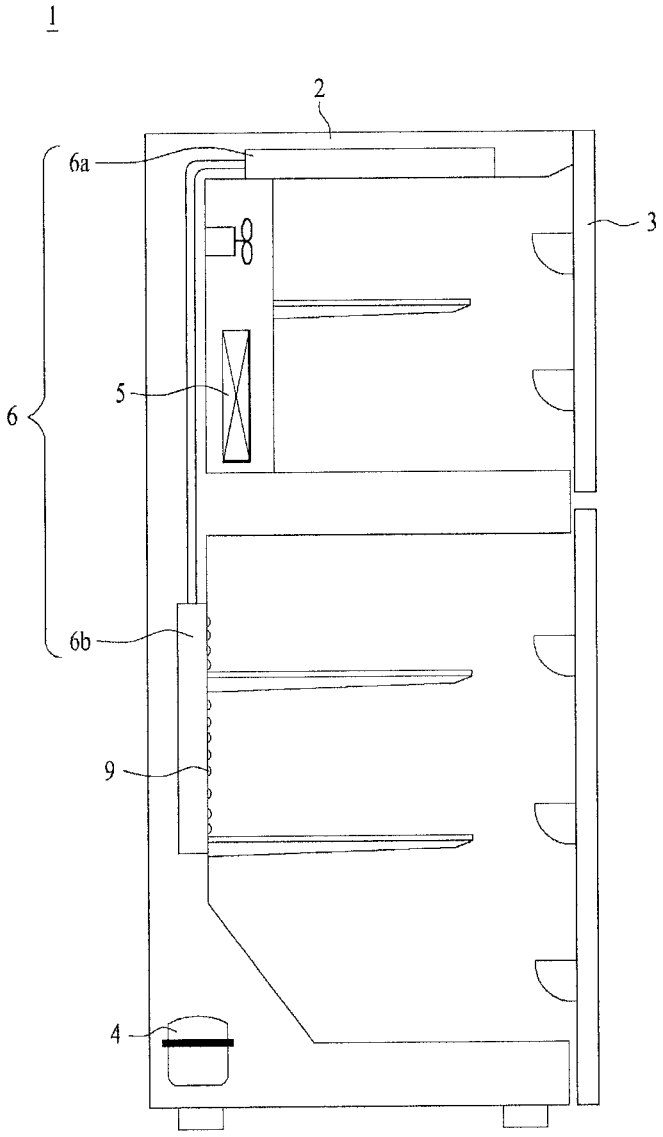
FIG. 1 is a side sectional view of a refrigerator according to one embodiment.

FIG. 1 is a side sectional view of a refrigerator. A refrigerator 1 may include a cabinet 2 that includes a storage chamber formed therein, a door 3 to open or close the storage chamber, and a cooling cycle that includes at least a compressor 4 and an evaporator 5 for cooling the storage chamber of the refrigerator. The storage chamber may be divided into a refrigeration compartment (refrigerator compartment) and a freezer compartment.

Moreover, the cooling cycle may include a working fluid (e.g., refrigerant) that circulates through the components of the cooling cycle. The compressor 4 may be arranged in a lower rear region of the cabinet 2. The evaporator 5 may be arranged on a rear wall of a freezer compartment of the refrigerator to undergo heat exchange to absorb heat from the freezer compartment. It should be appreciated that the location/position of the above described components are not limited to thereto and may be changed based on an operational or design considerations.

According to the operation of such the refrigerator, when the compressor is normally driven by an electric power normally supplied thereto, cold air is constantly supplied to maintain the temperature inside the refrigerator and there is no problem. However, when the cooling is stopped due to an error generated in the cooling cycle such as loss of power or a malfunction of the compressor, the temperature inside the refrigerator may unacceptably rise.

Particularly, the temperature inside a refrigeration compartment that stores perishable items may increase easily and may be more sensitive to loss of power than the freezing chamber. Accordingly, there is a demand for solutions to prevent or minimize a temperature increase inside the refrigeration compartment when the compressor is not operational, e.g., during power or component failures.

Cold air inside the freezer compartment may be used to delay the rise in temperature inside the refrigeration compartment. In this instance, a difference between the temperatures in the freezer and refrigeration compartments might cause a problem of condensation (also referred to herein as dew or dewdrops) forming on an inner side wall of the refrigeration compartment, which may lead to frost. Moreover, the condensation may form dewdrops which fall along the inner wall of the refrigerator, and may accumulate to spoil or otherwise damage the contents of the refrigerator.

Accordingly, as broadly described and embodied herein, a refrigerator may include an internal mechanism provided on an inner wall of a refrigeration chamber that prevents or minimizes accumulation of condensation. The refrigerator of the present disclosure may prevent or minimize condensation from falling down along a side wall to accumulate in the refrigeration chamber through enhancements to the structure of the side wall, and thereby prevent spoilage of food even during a power failure.

The embodiments of the disclosure may be integrated into Smart Grid technology. Smart Grid refers to an electrical grid that can integrate information technology (IT) into an electric grid to enable an electricity supplier and a consumer to interactively exchange information on electricity and to optimize energy efficiency.

According to the embodiment of the disclosure, failure of power supply to the refrigerator and a high electric bill situation may be recognized as the same situation. In the failure of power supply, external electric power is not supplied. During periods in which costs of electric power is high (e.g., high electric rates), the external electric power to the cooling system may be reduced or cut off. In other words, the electric power supplied by an external power supply source may not be used when electric rates are high, and an auxiliary cooling mechanism such as a thermosiphon may be driven. In relatively low electric charge hours, the thermosiphon may be turned off and the cooling cycle may be driven.

A different refrigerant may circulate in the thermosiphon according to the disclosure, independent from refrigerant that circulates in the cooling cycle provided in the refrigerator. The thermosiphon may perform cooling for the refrigeration compartment using the cold air provided in the freezer compartment. In this instance, the thermosiphon may perform an auxiliary function to the cooling cycle. When the thermosiphon is driven, the cooling cycle may be not operated. In contrast, when the cooling cycle is not operated, the thermosiphon may be operated. The situation in which the cooling cycle is not operational may include a power failure, failure of a component in the refrigerator, periods during which the electric rates are high (e.g., peak hours of power usage), or another appropriate situation in which the cooling cycle is not operational.

The meaning of not operating the cooling cycle may refer to the working fluid (refrigerant) not being circulated through the cooling cycle because the compressor operated by the electric power supplied from the external power supply source is not compressing the working fluid. Accordingly, the cold air is not supplied to the inside of the refrigerator via the cooling cycle.

Even while the external electric power is supplied, the cold air may not be supplied to the refrigeration compartment or the freezer compartment by the compressor of the cooling cycle. That is because the freezer or refrigeration compartment may have been cooled sufficiently and additional cold air circulation does not have to be performed.

Figure 2:
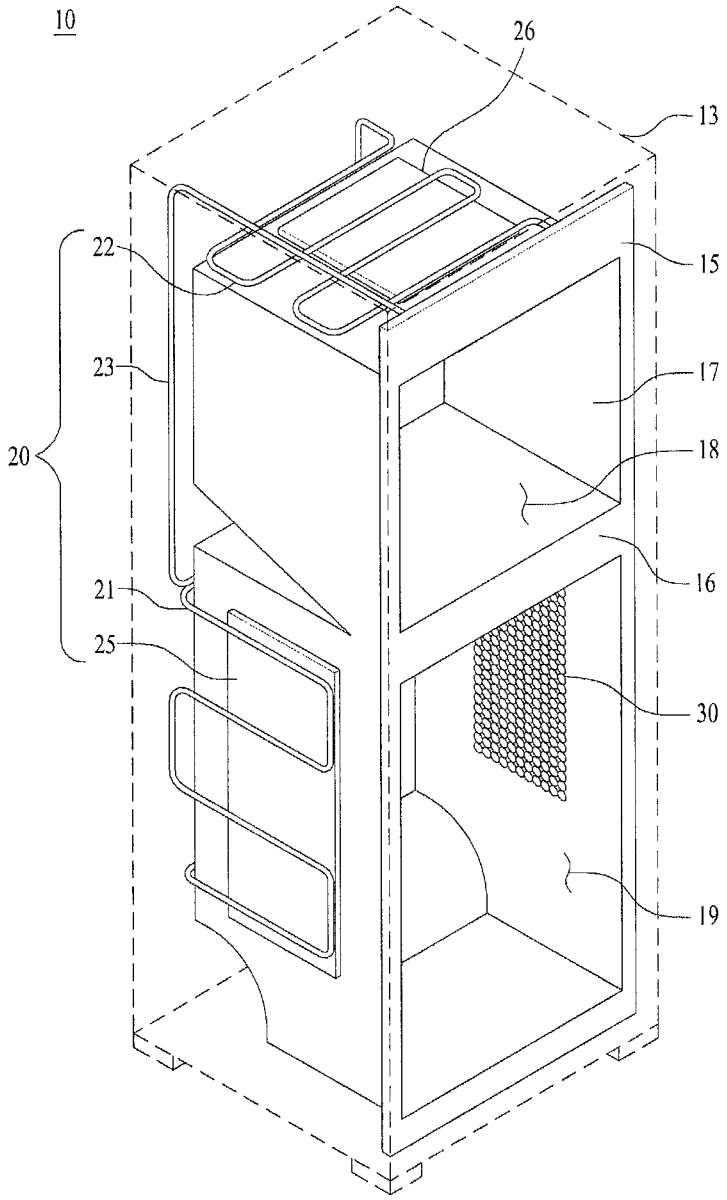
FIG. 2 is a perspective view of a refrigerator according to one embodiment.

FIG. 2 is a perspective view of a refrigerator according to one embodiment. The refrigerator 10 may include an outer case 13 or cabinet and an inner case 15 arranged inside the outer case 13. The inner case 15 may form the storage chamber and may include a partition wall 16 that partitions the storage chamber into a freezer compartment 18 and a refrigeration compartment 19 (refrigerator compartment) and a side wall surface 17 of the refrigerator. The refrigerator 10 may include a primary cooling mechanism to realize the cooling cycle to maintain the temperatures of the refrigeration compartment 19 and the freezer compartment 18 using external electric power, and an auxiliary cooling mechanism to suppress the rising of the temperature inside the refrigeration compartment 19 when the cooling cycle is not operated in the failure of power supply. The auxiliary cooling mechanism may have at least a predetermined portion adjacent to an outer surface of the side wall 17 of the refrigeration compartment 19.

Figure 9:
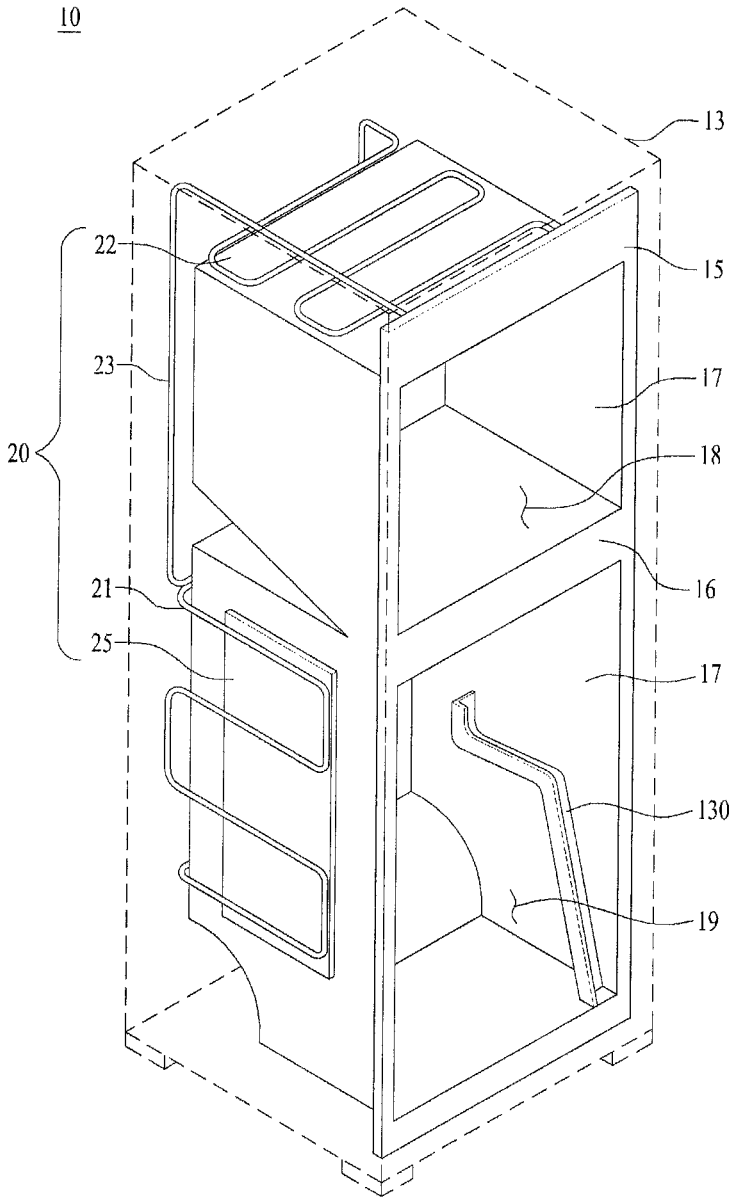
FIG. 9 is a perspective view illustrating a refrigerator according to one embodiment.

According to the embodiment, a condensation collection device (dew containing part) may be provided to prevent condensation formed on the inner side wall 17 of the refrigeration compartment from falling freely falling. The condensation collection device may be a surface 30 that has a prescribed texture, pattern, or unevenness. The textured or pattern of the surface 30 may be formed by a plurality of protrusions having a predetermined height. According to another embodiment, the condensation collection device may be an inclined guide 130 provided to catch and guide the droplets of condensation to a predetermined location (FIG. 9).

First, the surface 30 will be described. The surface 30 may be formed at a predetermined inner portion of the refrigerator side wall 17 adjacent to the auxiliary cooling mechanism.

The refrigerator 10 may include the outer case 13 that defines an exterior appearance thereof, the inner case 15 employed as an inner wall of the storage chamber of the refrigerator 10 and the primary cooling system arranged between the inner case 15 and the outer case 13. The outer case 13 may define the exterior appearance of the refrigerator 10 and it may include the storage chamber having the open portion. The open portion of the outer case 13 may be opened or closed by a door 3.

The inner case 15 may be arranged in the outer case 13 and may include the partition wall 16 and the side wall 17. The partition wall 16 may partition the storage chamber into the freezer compartment 18 and the refrigeration compartment 19. The side wall 17 may define the inner walls of the refrigeration compartment 19 and the freezer compartment 18, covering the refrigerator component parts such that they are not exposed to the user.

The primary cooling mechanism for realizing the cooling cycle operates the compressor to compresses the working fluid artificially and it operates the condenser to change the working state of the fluid to a liquid state. The working fluid in the liquid state is changed into a gaseous state via pressure reduction and expansion in the expander and evaporator. Accordingly, heat exchange may be performed and temperature inside the storage chambers may be lowered.

The external electric power is supplied to operate the compressor to continuously cool the inside of the refrigerator 10. However, in the failure of the external electric power supply, the operation of the compressor is stopped and the cooling cycle is not operational. Accordingly, the temperature inside the refrigerator 10 may rise.

The auxiliary cooling mechanism may include at least a predetermined portion placed adjacent to an outer surface of the refrigeration compartment side wall 17 to suppresses the rise of the temperature inside the refrigeration compartment 19 in the event the cooling cycle is not operational.

The auxiliary cooling mechanism may be used for solving the problem of spoilage generated in the foods preserved in the refrigeration compartment 19 rather than the freezer compartment because the temperature of the refrigeration compartment 19 may rise more rapidly without the electric power supply than the freezing compartment. As the temperature of the freezer compartment 18 is relatively lower than that of the refrigeration compartment 19, the auxiliary cooling mechanism may use the cold air inside the freezer compartment 18 to temporarily suppress the rise in temperature of the refrigeration compartment 19 in the event of a power failure.

To enhance the performance of the auxiliary cooling mechanism, a phase change material may be additionally provided. The phase change material may store thermal energy during normal operation of the refrigerator 10, which may be used to cool the refrigerator compartments during power outages or failures. The auxiliary cooling mechanism may not affect the temperature of the refrigeration compartment 19 during the normal operation of the refrigerator 10, but it may suppress the rise of the temperature inside the refrigeration compartment 19, when the cooling cycle is not operated in the failure of power supply.

A notable example of the auxiliary cooling mechanism capable of transferring the cold air of the freezer compartment 18 may be a thermosiphon 20 shown in FIG. 2. The thermosiphon 20 is a device that moves heat according to a principle that heat flows to a low place from a high place, without auxiliary energy applied thereto, such that cold air or hot air in an area may be moved to the other area having a different temperature.

A vaporization temperature of refrigerant used in the thermosiphon may be the same as or lower than the highest temperature of the refrigeration compartment when the cooling cycle is driven. In the thermosiphon, an evaporating part may be arranged in the refrigeration compartment 19 and it may absorb the heat of the refrigeration compartment 19 to phase-change a liquid refrigerant of the evaporating part into a gas refrigerant. When the vaporization temperature of the refrigerant is lower than the highest temperature of the refrigeration compartment 19, the refrigerant is vaporized after absorbing the heat of the refrigeration compartment 19 in all situations at which the cooling cycle is normally driven.

Meanwhile, the vaporization temperature of the refrigerant used in the thermosiphon may be the same as or lower than an average temperature of the refrigeration compartment in a specific mode simultaneously set when the cooling cycle is driven. In this instance, the refrigerant accommodated in the evaporating part may be vaporized at a lower temperature than the temperature of the refrigeration compartment 19 in a specific mode (for example, a low temperature refrigerating mode and a high temperature refrigerating mode) set automatically or by the user. Accordingly, a vaporization temperature change band of the refrigerant used in the thermosiphon may be limited.

Specifically, the vaporization temperature of the refrigerant used in the thermosiphon may be the same as or lower than the lowest temperature of the refrigeration compartment realized when the cooling cycle is driven. To drive the thermosiphon efficiently, the temperature of the refrigeration compartment absorbing the heat from the evaporating part may be relatively high, compared with the temperature of the evaporating part. In this instance, the refrigerant is vaporized at the lowest temperature of the evaporating part or lower such that the vaporization of the refrigerant may be performed in the evaporator smoothly and rapidly.

The thermosiphon 20 may include an evaporating part 21 located in the refrigeration compartment 19 and a condensing part 22 located in the freezer compartment 18. The refrigeration compartment 19 and the freezer compartment 18 are heat-exchanged with each other by the refrigerant circulating through the evaporating part 21 and the condensing part 22.

The thermosiphon 20 may be operated only when the cooling cycle is not operated normally, and the circulating path of the refrigerant may be shut off by a valve to prevent circulation of the refrigerant when the cooling cycle is operated normally. The valve may be configured to be open to circulate the refrigerant only in the event of a power failure.

The condensing part 22 may be located at the freezer compartment 18 and the gaseous refrigerant is phase-changed into the liquid refrigerant in the condensing part 22. The condensing part 22 may emit the heat of the refrigerant toward the freezer compartment 18 and may store the cold air in the refrigerant.

The condensing part 22 may be configured of a pipe having a winding or serpentine shape to enlarge a surface area for smooth heat exchange. Also, to enlarge the surface area, a heat transfer plate 26 may be attached to the condensing part 22. The heat transfer plate 26 may be formed of a material having high heat conductivity such as metal. The condensing part 22 may be referred herein to as a condenser.

While FIG. 2 shows the condensing part 22 to be positioned on top outer surface of the freezer compartment 18, the present disclosure is not limited thereto. The condensing part 22 may be arranged adjacent to a side wall or bottom surface of the freezer compartment 18 to heat-exchange with the freezer compartment 18. Moreover, the condensing part 22 may be positioned within the walls of the freezing chamber as well as on an inner surface of the freezing chamber.

A member capable of storing cold air such as a phase change material (PCM) may be provided adjacent to the condensing part 22 to supply cold air to the condensing part 22 during a power failure.

The evaporating part 21 may be located adjacent to the refrigeration compartment 19. The liquid refrigerant liquefied in the condensing part 22 may be moved to the evaporating part 21 via a second connection pipe 23 and it may absorb the heat of the refrigeration compartment 19 to be phase-changed into the gas refrigerant.

The shape of the evaporating part 21 may be a winding or serpentine pipe shape to enlarge the surface area. Alternatively, a heat transfer plate 25 may be attached to the condensing part to enlarge a heat exchange area. Especially, the heat transfer plate 25 may be formed of a high heat conductive material such as metal. The evaporating part 21 may be referred herein to as an evaporator.

The evaporating part 21 may be arranged at each of the side walls of the freezer compartment 19 to transfer cold air to the refrigeration compartment 19 uniformly, as shown in FIG. 2. The evaporating part 21 may be adjacent to an outer surface of the side wall 17, such that the refrigerant that has a low temperature in the freezer compartment 18 may heat-exchange with the inside of the refrigeration compartment 19 via the side wall 17. The evaporating part may also be provided within the walls of the refrigeration compartment.

In one embodiment, the thermosiphon 20 may be provided in the partition wall 16. For example, the condensing part 22 may be positioned within the partition wall and configured to undergo heat exchange with the freezing compartment 18. The evaporating part 21 may also be positioned in the partition wall and configured to undergo heat exchange with the refrigeration compartment 19.

At this time, the temperature of the refrigerant passing through the evaporating part 21 may be quite different from the temperature of the refrigeration compartment 19. When the electric power is applied, air may be circulated by a fan or a heating wire may be used to prevent a partial difference between the temperatures. However, the help of such mechanisms cannot be used in the event of a power failure.

The temperature of the refrigerant passing through the thermosiphon 20 may be below 32° F. (0° C.) after being transferred from the freezer compartment 18 while the temperature of the refrigeration compartment 19 may be 50° F. (10° C.) or higher after rising from the temperature of the refrigeration compartment 19 when the cooling cycle is operated normally. In other words, there is a temperature difference of approximately 18° F. (10° C.) between the refrigerant passing the thermosiphon 20 and the refrigeration compartment 19. Accordingly, condensation may be formed on the side wall 17 of the refrigerator, similar to water drops that form on a glass filled with ice water.

The cooling cycle is operated normally and the temperature of the refrigeration compartment 19 is maintained uniformly. When the thermosiphon 20 is not operated, the condensation formed by the operation of the thermosiphon 20 may be evaporated to disappear.

However, if the power supply failure lasts for a predetermined time period or more, the size of the dew might be enlarged. If the weight of the dew is larger than a frictional force between the side wall and the dew, the dew might fall to be gathered on the bottom of the refrigerator or fall on the foods preserved in the refrigerator 10 to spoil the food in the refrigerator. A greater amount of condensation may form in geographical regions having a high temperature and humidity condition (for example, the temperature of 90° F. (32° C.) and the humidity of 87.5%).

The surface 30 formed in an inner surface of the side wall 17 may be structured to prevent the dew from falling from the side wall 17 to prevent the dew from falling to the bottom along the side wall 17 or spoilage of the foods. The surface 30 may increase the contact area with the dew to enhance the frictional force or surface tension between the side wall and the droplets of condensation. Even when condensation is formed in the surface 30, the movement of the droplets may be reduced by the force.

The surface 30 may be formed on an inner surface of the refrigeration compartment side wall 17 adjacent to the evaporating part of the auxiliary cooling mechanism, namely, the thermosiphon 20 in the embodiment shown in FIG. 2. Condensation may be formed by the temperature difference between the evaporating part of the thermosiphon 20 and the portion of the side wall 17 adjacent to the evaporating part.

Figure 3:
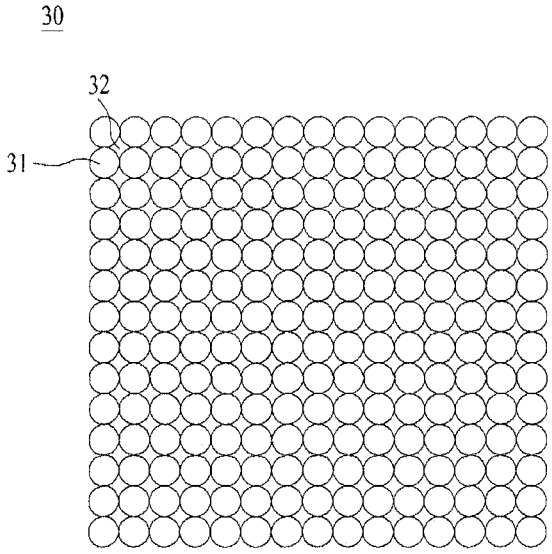
FIG. 3 is a plane view of a side wall of the refrigerator according to one embodiment.
Figure 4:
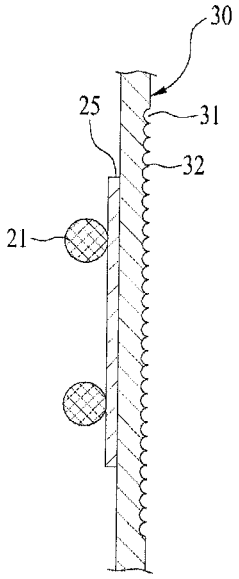
FIG. 4 is a side sectional view of the side wall of the refrigerator according to the embodiment of FIG. 3.
Figure 5:
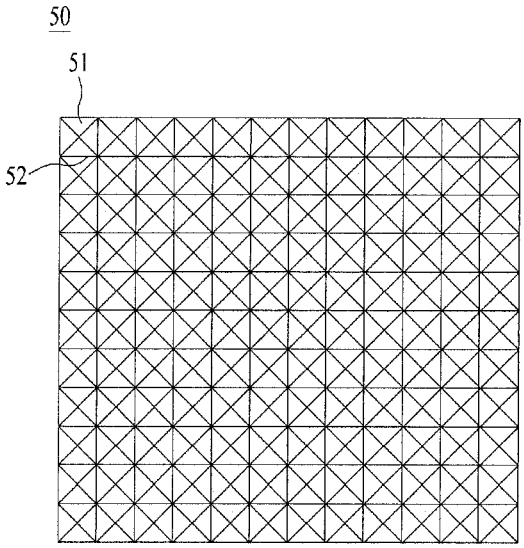
FIG. 5 is a plan view of a side wall of a refrigerator according to one embodiment.
Figure 6:
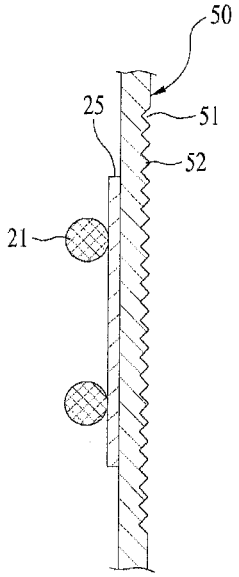
FIG. 6 is a side sectional view of the side wall of the refrigerator according to the embodiment of FIG. 5.

FIG. 3 is a plane view of a side wall of the refrigerator according to one embodiment and FIG. 4 is a side sectional view of the side wall of the refrigerator according to the embodiment of FIG. 3. FIG. 5 is a plan view of a side wall of a refrigerator according to one embodiment and FIG. 6 is a side sectional view of the side wall of the refrigerator according to the embodiment of FIG. 5.

As illustrated in FIGS. 3 and 4, the surface 30 may have a concave part 51 (concave region) formed in a hemisphere shape corresponding to the water drop shape. Alternatively, as illustrated in FIGS. 5 and 6, a quadrangular-pyramid-shaped concave part 51 may be formed for a convenient manufacturing process.

In this instance, an area of the surface of the refrigeration compartment side wall 17 where the surface 30 is formed may be smaller than an area of the heat transfer plate 25. The cold air transferred via the evaporating part may be transferred to the heat transfer plate 25 and the cold air transferred by the heat transfer plate 25 may be transferred to the side wall 17. Accordingly, the area where condensation can be formed on the side wall 17 is larger than the area where the heat transfer plate 25 is in contact with the side wall 17.

Meanwhile, the evaporating part 21 and the heat transfer plate 25 may be in physical contact with each other. Also, the heat transfer plate 25 and the refrigeration compartment side wall 17 may be in physical contact with each other. The cold air may be transferred efficiently from the evaporating part to the refrigeration compartment by the contact area. In one embodiment, the heat transfer plate 25 may have grooves formed thereon to accommodate the pipes of the evaporating part 21, thereby further improving heat transfer. Similar modifications may be made to the heat transfer plate 26 for the condensing part 22.

Figure 7:
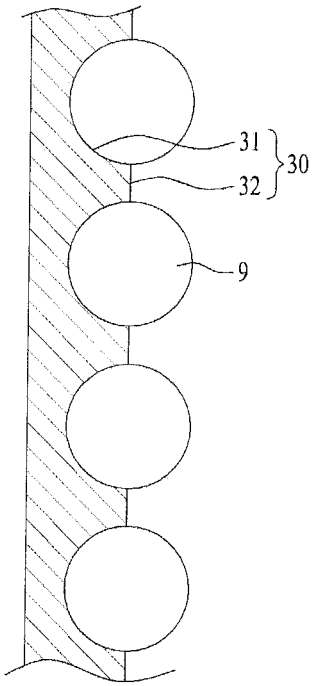
FIG. 7 is a side sectional view illustrating condensation formed on an inner surface of the refrigerator side wall according to one embodiment.
Figure 8:
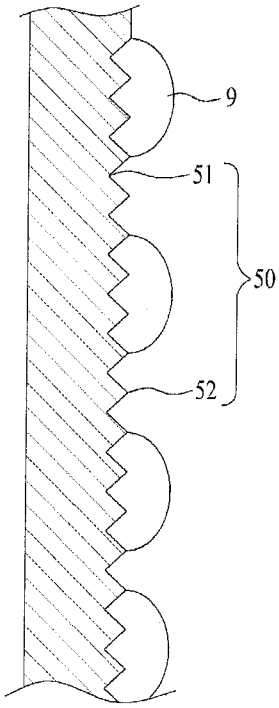
FIG. 8 is a side sectional view illustrating condensation formed on an inner surface of the refrigerator side wall according to another embodiment.

FIGS. 7 and 8 are a side sectional views illustrating condensation formed on an inner surface of the refrigerator side wall. The surfaces 30 and 50 may have a breath of 0.1 mm or more and 10 mm or less. If the surface 30 and 50 is too large, the effect of increasing the frictional force with the dew 9 might deteriorate and the size of the surface 30 and 50 have to be corresponding to or smaller than that of the droplet 9 of condensation.

When the size of the surface 30 is corresponding to the size of the droplet 9, the droplet 9 may be formed in the concave part 31 and the droplet 9 may be prevented from falling down to the bottom of the refrigerator 10, as illustrated in FIG. 7, compared with an smooth or flat side wall of the conventional refrigerator.

As illustrated in FIG. 8, even when the size of the surface 50 is smaller than that of the droplet 9, the contact area between the surface and the droplet 9 may be increased and the frictional force with the inner surface of the side wall 17 may be increased accordingly. Compared with the even side wall, the problem of condensation falling down to the bottom of the refrigerator 10 may be solved.

While the surface 30 was shown to have a pattern of a size similar to the dewdrop and the surface 50 was shown to have a pattern size smaller than the droplet, the present disclosure is not limited thereto, and it should be appreciated that the size of the pattern for surface 30 may be reduced to increase surface tension.

To increase the effect of preventing the dew 9 from falling down along the side wall 17, the inner surface of the side wall 17 where the surface 30 and 50 may be formed of a material having a high coefficient of friction. Alternatively, the inner surface of the side wall 17 where the surface 30 and 50 is formed may have anti-condensation coatings or paint to reduce the dew 9 formed on the side wall 17. When the side wall 17 is coated with anti-condensation material, the side wall 17 may have a function of maintaining the moisture temporarily. When the cooling cycle is operated normally again, the moisture may be evaporated and dried naturally.

As described above, the refrigerator 10 according to the embodiments of the disclosure may reduce the dew 9 formed on the inner surface of the side wall 17 of the refrigerator 10 by the temperature difference even in the failure of power supply and may prevent the foods from being spoiled by the dew 9 falling down to the bottom of the refrigerator 10 along the inner surface of the side wall 17.

FIG. 9 is a perspective view illustrating a refrigerator according to a further embodiment and the refrigerator will be described in reference to FIG. 9 as follows. This embodiment presents a guide 130 configured to guide dew formed on an inner surface of the refrigeration compartment side wall to a dew containing part.

In this instance, the guide 130 may be provided on each of the side walls of the refrigeration compartment 19. Although not shown in FIG. 9 specifically, the guides 130 may be formed on the inner surfaces of the side walls in symmetry with each other. Moreover, the guide 130 may be positioned to correspond to a position of the evaporating part 21, as a greater amount of condensation may form on a surface near the evaporating part 21.

The guide 130 may be projected a predetermined height from the refrigeration compartment side wall 17. Accordingly, the condensation formed on the refrigeration compartment side wall 17 may be guided along a downward direction by the auxiliary cooling mechanism and it may be received in the guide 130 temporarily.

A sectional area of the guide 130 may be bent in a "L" shape the condensation received in the guide 130 may be prevented from falling out of a side surface of the guide 130 by a surface of the guide formed on the side wall. For example, the guide 130 may form a channel for the condensation to flow.

The guide 130 may be tilted or inclined a predetermined angle and the condensation received in the guide 130 may be guided to a predetermined place along the guide 130. For example, the guide 130 may guide the condensation to a reservoir or drain which may be provided at a bottom region of the refrigeration chamber. Accordingly, the condensation formed in the side wall 17 may not fall down freely to spoil or otherwise damage the perishable contents of the refrigerator. In one embodiment, the condensation collection surface 30, 50 and the guide 130 may be used together.

Accordingly, as broadly described and embodied herein, a refrigerator may include an internal mechanism provided on an inner wall of a refrigeration chamber that prevents or minimizes accumulation of condensation. The refrigerator of the present disclosure may prevent or minimize condensation from falling down along a side wall to accumulate in the refrigeration chamber through enhancement to the structure of the side wall, in order to prevent spoilage of food even during a power failure.

In one embodiment, a refrigerator may include a refrigerator body having a freezing compartment and a refrigeration compartment, a cooling circuit including a compressor, a first condenser, and a first evaporator to cool the freezing compartment and the refrigeration compartment using a first refrigerant, a thermosiphon that includes a second condenser provided at the refrigeration compartment and a second evaporator provided at the freezing compartment for a second refrigerant to flow, a valve provided to control a flow of the second refrigerant in the thermosiphon, a first heat transfer plate provided between the second condenser and the freezing compartment, a second heat transfer plate provided between the second evaporator and the refrigeration compartment, and a condensation collection device provided at an inner side wall of the refrigerator compartment and positioned to correspond to a position of the second heat exchange plate to collect dew formed on the inner side wall of the refrigerator compartment.

In this embodiment, the freezing compartment may be positioned over the refrigeration compartment, and the second condenser of the thermosiphon may be positioned higher than the second evaporator. The second cooling system may be configured to operate when the first cooling system does not operate.

The condensation collection device may include a plurality of protrusions provided on an inner surface of the refrigeration chamber opposite the second evaporator, and the plurality of protrusions being positioned a prescribed distance from each other to hold condensation by surface tension. The plurality of protrusions may be formed integrally on the inner surface of the refrigeration chamber. The plurality of protrusion may have a predetermined height. The plurality of protrusions may form concave regions that have a hemisphere shape between adjacent protrusions. The plurality of protrusions may form concave regions that have a quadrangular pyramid shape between adjacent protrusion. The plurality of protrusions may be positioned between 0.1 mm and 10 mm from each other. Moreover, an area of the heat transfer plate may be smaller than an area of the refrigerator compartment side wall where the plurality of protrusions are formed.

The first heat transfer plate may be provided adjacent to an outer top surface of the freezing compartment and the second condenser, and the second heat transfer plate may be provided adjacent to an outer side surface of the refrigeration compartment and the second evaporator. The second evaporator may be in contact with the second heat transfer plate. The second heat transfer plate may be in contact with the outer surface of the refrigeration compartment.

The condensation collection device may include a channel that protrudes a prescribed distance from the inner side wall of refrigerator compartment. The channel may be inclined at a prescribed angle such that the dew collected in the guide flows down along the guide. The channel may be positioned one the inner side wall of the refrigeration compartment opposite to the second evaporator.

The cooling cycle may be configured of a compressor to compress a working fluid, using an external electric power, and an evaporator to heat-exchange the working fluid supplied thereto. Moreover, an inner surface of the side wall that corresponds to a position of the condensation collection device may have an anti-condensation coating formed thereon.

In one embodiment, a refrigerator may include a refrigerator body having a freezing compartment and a refrigeration compartment, a cooling circuit including a compressor, a first condenser, and a first evaporator to cool the freezing compartment and the refrigeration compartment using a first refrigerant, a thermosiphon that includes a first heat exchange pipe, a second heat exchange pipe, a first pipe for a second refrigerant to flow from the first heat exchange pipe to the second heat exchange pipe, and a second pipe for the second refrigerant to flow from the second heat exchange pipe to the first heat exchange pipe, a valve provided to control a flow of the second refrigerant in the thermosiphon, a first heat transfer plate positioned between the first heat exchange pipe and an outer surface of the freezing chamber, a second heat transfer plate positioned between the second heat exchange pipe and an outer surface of the refrigeration chamber, and a dew collection device provided at an inner side wall of the refrigerator compartment and positioned to correspond to a position of the second heat exchange plate to collect dew formed on the inner side wall of the refrigerator compartment.

The second refrigerant may change a state from a gas to a liquid in the first heat exchange pipe and changes state from a liquid to gas in the second heat exchange pipe. The first heat exchange pipe is positioned at the freezing compartment to undergo heat exchange with the freezing compartment and the second heat exchange pipe is positioned at the refrigeration compartment to undergo heat exchange with the refrigeration compartment.

In one embodiment, a refrigerator may include a refrigerator body having a freezing compartment and a refrigeration compartment, a cooling circuit including a compressor, a first condenser, and a first evaporator to cool the freezing compartment and the refrigeration compartment using a first refrigerant, a thermosiphon that includes a first heat exchange pipe, a second heat exchange pipe, a first pipe for a second refrigerant to flow from the first heat exchange pipe to the second heat exchange pipe, and a second pipe for the second refrigerant to flow from the second heat exchange pipe to the first heat exchange pipe.

The second refrigerant may change a state from a gas to a liquid in the first heat exchange pipe and may change a state from a liquid to gas in the second heat exchange pipe, and the first heat exchange pipe may be positioned at the freezing compartment to undergo heat exchange with the freezing compartment and the second heat exchange pipe is positioned at the refrigeration compartment to undergo heat exchange with the refrigeration compartment.

The refrigerator may include a valve provided at the second connecting pipe to open or close the second connecting pipe, and a dew collection device provided at an inner side wall of the refrigerator compartment and positioned to correspond to a position of the second heat exchange plate to collect dew formed on the inner side wall of the refrigerator compartment.

The freezing compartment may be positioned over the refrigeration compartment and a first heat transfer plate positioned between the first heat exchange pipe and an outer top surface of the freezing chamber, and a second heat transfer plate may be positioned between the second heat exchange pipe and an outer side surface of the refrigeration chamber.

In one embodiment, a refrigerator may include an inner case arranged in an outer case, the inner case comprising a partition wall to partition a storage chamber into a freezer compartment and a refrigerator compartment and a side wall of the refrigerator; an auxiliary cooling mechanism to suppress rising of a temperature in the refrigerator compartment, when a cooling cycle is not operated by an external electric power in failure of power supply, the auxiliary cooling mechanism having at least a predetermined portion adjacent to an outer surface of a refrigerator compartment side wall; and a dew containing part provided in an inner surface of the refrigerator compartment side wall to contain dew formed on the inner surface of the refrigerator compartment side wall by the auxiliary cooling mechanism.

The auxiliary cooling mechanism may include a condensing part provided in the freezer compartment; an evaporating part adjacent to an outer surface of the refrigerator compartment side wall; and a refrigerant circulating the condensing part and the evaporating part to heat-exchange with the freezer compartment and the refrigerator compartment.

The dew containing part may be an unevenness having a predetermined height. The unevenness may include a concave part having a hemisphere shape. A plurality of concave parts may be provided and dew may be received in the plurality of the concave parts. The unevenness may include a concave part having a quadrangular pyramid shape. The breath of the unevenness may be 0.1 mm or more to 10 mm or less.

The auxiliary cooling mechanism may further include a heat transfer plate provided between the evaporating part and the refrigerator compartment side wall to assist heat exchange between the evaporating part and the refrigerator compartment. An area of the heat transfer plate may be smaller than an area of the refrigerator compartment side wall where the unevenness is formed. The evaporating part may be in contact with the heat transfer plate. The heat transfer plate may be in contact with the refrigerator compartment side wall.

The dew containing part may include a guide projected a predetermined height from the refrigerator compartment side wall. The guide may be tilted a predetermined angle and the dew contained in the guide may be moved down along the tilted direction.

The cooling cycle may be configured of a compressor to compress a working fluid, using an external electric power, and an evaporator to heat-exchange the working fluid supplied thereto. Moreover, an inner surface of the side wall where the dew containing part may be formed is anti-sweating-painted.

In another aspect of the disclosure, a refrigerator includes an inner case arranged in an outer case, the inner case comprising a partition wall to partition a storage chamber into a freezer compartment and a refrigerator compartment and a side wall of the refrigerator; and an auxiliary cooling mechanism to suppress rising of a temperature in the refrigerator compartment, when a cooling cycle is not operated by an external electric power in failure of power supply, the auxiliary cooling mechanism having at least a predetermined portion adjacent to an outer surface of a refrigerator compartment side wall, wherein an unevenness is formed in an inner surface of a refrigerator compartment side wall adjacent to the auxiliary cooling mechanism, and the auxiliary cooling mechanism further comprises a heat transfer plate provided between the evaporating part and the refrigerator compartment side wall to assist heat exchange between the evaporating part and the refrigerator compartment.

An area of the heat transfer plate may be smaller than an area of the refrigerator compartment side wall where the unevenness is formed. The unevenness may include a concave part having a hemisphere shape.

In a further aspect of the disclosure, a refrigerator includes an inner case arranged in an outer case, the inner case comprising a partition wall to partition a storage chamber into a freezer compartment and a refrigerator compartment and a side wall of the refrigerator; an auxiliary cooling mechanism to suppress rising of a temperature in the refrigerator compartment, when a cooling cycle is not operated by an external electric power in failure of power supply, the auxiliary cooling mechanism having at least a predetermined portion adjacent to an outer surface of a refrigerator compartment side wall; and a guide projected a predetermined height from a refrigerator compartment side wall, wherein the guide guides dew formed in the refrigerator compartment side wall in a downward direction. In this embodiment, the guide may be formed in each of the refrigerator compartment side walls.

According to the embodiments of the disclosure, the refrigerator may minimize the dew formed on the inner surface of the refrigerator compartment side wall by the temperature difference even in failure of power supply and it may prevent the dew from falling down to the bottom of the refrigerator and spoiling the foods preserved in the refrigerator compartment.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a refrigerator body having a freezing compartment and a refrigeration compartment;

a cooling circuit including a compressor, a first condenser, and a first evaporator to cool the freezing compartment and the refrigeration compartment using a first refrigerant;

a thermosyphon that includes a second condenser provided at the freezing compartment and a second evaporator provided at the refrigeration compartment for a second refrigerant to flow;

a valve provided to control a flow of the second refrigerant in the thermosyphon; and a condensation collection device provided at an inner side wall of the refrigeration compartment to collect dew formed on the inner side wall of the refrigeration-compartment.

2. The refrigerator of claim 1, wherein the freezing compartment is positioned over the refrigeration compartment, and the second condenser of the thermosyphon is positioned higher than the second evaporator.

3. The refrigerator of claim 1, wherein the thermosyphon is configured to operate when the cooling circuit does not operate.

4. The refrigerator of claim 1, wherein the condensation collection device includes a plurality of protrusions provided on an inner surface of the refrigeration compartment opposite the second evaporator.

5. The refrigerator of claim 4, wherein the plurality of protrusions are formed integrally on the inner surface of the refrigeration compartment.

6. The refrigerator of claim 4, wherein the plurality of protrusions form concave regions between adjacent protrusions.

7. The refrigerator of claim 6, wherein the plurality of protrusions form concave regions that have a quadrangular pyramid shape between adjacent protrusion.

8. The refrigerator of claim 4, wherein the plurality of protrusions are positioned between 0.1 mm and 10 mm from each other.

9. The refrigerator of claim 4, further comprising a heat transfer plate provided between the second evaporator and the refrigeration compartment.

10. The refrigerator of claim 9, wherein an area of the heat transfer plate is smaller than an area of the refrigerator compartment side wall where the plurality of protrusions are formed.

11. The refrigerator of claim 9, wherein the heat transfer plate is provided adjacent to an outer side surface of the refrigeration compartment and the second evaporator.

12. The refrigerator of claim 11, wherein the second evaporator is in contact with the heat transfer plate.

13. The refrigerator of claim 12, wherein the heat transfer plate is in contact with the outer surface of the refrigeration compartment.

14. The refrigerator of claim 4, further comprising a heat transfer plate provided between the second condenser and the freezing compartment.

15. The refrigerator of claim 14, wherein the heat transfer plate is provided adjacent to an outer top surface of the freezing compartment and the second condenser.

16. The refrigerator of claim 1, wherein the condensation collection device includes a channel on the inner side wall of refrigerator compartment.

17. The refrigerator of claim 16, wherein the channel is inclined such that the dew collected in the channel flows down along the channel.

18. The refrigerator of claim 16, wherein the channel is positioned on the inner side wall of the refrigeration compartment.

19. The refrigerator of claim 1, wherein an inner surface of the side wall that corresponds to a position of the condensation collection device has an anti-condensation coating formed thereon.

20. The refrigerator of claim 1, wherein the thermosyphon further includes:

a first pipe for the second refrigerant to flow from the second condenser to the second evaporator; and a second pipe for the second refrigerant to flow from the second evaporator to the second condenser, wherein the second refrigerant changes state from a gas to a liquid in the second condenser and changes stage from a liquid to gas in the second evaporator.

* * * * *